US005121695A

United States Patent [19]

Feuz

[11] Patent Number: 5,121,695

[45] Date of Patent: Jun. 16, 1992

[54] OVERHEAD CABLEWAY

[75] Inventor: Fritz Feuz, Thun, Switzerland

[73] Assignee: Von Roll Transportsysteme AG, Thun, Switzerland

[21] Appl. No.: 627,830

[22] Filed: Dec. 17, 1990

[30] Foreign Application Priority Data

Dec. 21, 1989 [CH] Switzerland ..... 04597/89

[51] Int. Cl.[5] ..... B61B 7/06; B61B 12/12; E01B 25/22; B61K 7/02

[52] U.S. Cl. ..... 104/178; 104/87; 104/91; 104/229; 104/230; 105/150; 105/153; 188/43; 188/62

[58] Field of Search ..... 104/87, 89, 106, 112, 104/91, 93, 229, 230, 178; 105/149.2, 150, 151, 152, 153; 188/42, 4362, 63

[56] References Cited

U.S. PATENT DOCUMENTS

| | | | |
|---|---|---|---|
| 3,827,368 | 8/1974 | Garnier | 104/112 |
| 3,850,280 | 11/1974 | Ohrnell | 105/150 |
| 4,003,314 | 1/1977 | Pearson | 104/178 |
| 4,563,955 | 1/1986 | Tarassoff | 105/150 |
| 4,627,361 | 12/1986 | Tarassoff . | |
| 4,669,389 | 6/1987 | Tarassoff | 104/178 |
| 4,691,642 | 9/1987 | Creissels | 104/112 |
| 4,794,864 | 1/1989 | Feuz et al. | 104/178 |
| 4,942,823 | 7/1990 | Meindl | 104/178 |

FOREIGN PATENT DOCUMENTS

| | | |
|---|---|---|
| 0249839 | 12/1987 | European Pat. Off. . |
| 0671552 | 6/1986 | Switzerland . |
| 0661013 | 6/1987 | Switzerland . |

*Primary Examiner*—Joseph F. Peters, Jr.
*Assistant Examiner*—Virna Lissi Mojira
*Attorney, Agent, or Firm*—Cushman, Darby & Cushman

[57] ABSTRACT

An overhead cableway is disclosed, in particular a chair lift, with a cable revolving between stations and with transport devices having a traveling gear and connected with the cable via removable clamps. Travel segments are provided at every station which include driven friction wheels, which act on the transport devices via friction surfaces provided on their traveling gear, and forming at least one deceleration and one acceleration section each, and with guide elements associated with the travel segments, which cooperate with the traveling gear. In accordance with the invention, the friction wheels (6,10) define traveling surfaces (20) and the transport devices (50) are supported by their downwardly oriented friction surfaces (88) directly on the friction wheels, and the guide elements (48) are seated rotatably and fixed in place.

10 Claims, 3 Drawing Sheets

OVERHEAD CABLEWAY

FIELD OF THE INVENTION

The invention relates to an overhead cableway, in particular a chair lift, with a cable revolving between stations and with transport devices having a traveling gear and being connected with the cable via removable clamps, with travel segments at every station comprising driven friction wheels, which act on the transport devices via friction surfaces provided on their traveling gear, and forming at least one deceleration and one acceleration section each, and with guide elements associated with the travel segments, which cooperate with the traveling gear.

BACKGROUND OF THE INVENTION

An overhead cableway of this type is already known from Swiss Letters Patent CH-PS 671552. In this case a travel or transfer rail extends along the transfer segment, on which the transport devices, which have been uncoupled from the transport cable, move until their support, guidance and drive is again provided by the transport cable following the completed recoupling process.

High contact pressure force is required in order to assuredly provide the frictional engagement between the friction wheels and the friction surfaces provided on the friction plates in the deceleration and acceleration section even under unfavorable frictional conditions caused by weather conditions or with maximum load or mass of the transport devices. The contact pressure forces require a size of the transfer rail and its suspension as well as of the friction wheels and their seating which is sufficiently large to assure stability. It is of even greater importance for the installation that the multitude of the transport devices moving within it must be designed to take up the contact pressure forces acting on the friction plates or to transfer corresponding reaction forces between themselves and the transfer rail. It is a fact that a sufficiently strong design of all parts has an effect not only in regard to the costs of the installation and in particular of the transport devices themselves, but also in regard to the operating costs, since the empty weight usually is unfavorable, even with the customary lightweight construction.

SUMMARY OF THE INVENTION

It is the object of the present invention to provide an overhead cableway which permits the avoidance of the above recited disadvantages on the part of the transport devices as well as the station installation by means of a simplified application of the contact pressure force.

This object is attained by means of the features in the characterizing part of claim 1.

The contact pressure force required for frictional engagement is provided in accordance with the invention either totally or partially by the own weight of the transport devices. In connection with the size of the required contact pressure force it is of importance that in the arrangement of the friction surfaces in accordance with the invention the frictional conditions between these and the friction wheels are changed to only a small degree even under the influence of winter weather. Particularly, no snow can adhere to the friction surfaces and a tendency for the build-up of ice on them is thus also reduced.

Because the friction wheels form the traveling surface in the travel segments equipped with them, only the guidance of the transport devices remains to be provided in these segments. For this reason a fixed travel rail taking on a support function is no longer required here. Thus the extent of the customarily provided transfer rail can be limited to the travel segment(s) where no friction wheels are present. The transfer rail may also be unnecessary in other travel segments of the transfer segment used for deceleration or acceleration, where usually driven friction wheels for the continued moving of the transport devices are already provided. It is known per se to provide driven friction wheels in the unloading and loading segments.

It is possible in principle to do completely away with a transfer rail, this particularly at intermediate stations where an unloading and a loading segment follow each other in a straight line and where the traveling and guidance surface between them is formed exclusively by friction wheels.

Alternately it would be possible to restrict the function of the transfer rail in the area of the friction wheels to providing a guidance by disposing them so that they give resiliently in the direction of contact pressure.

If a higher contact pressure force should be required than can be assuredly provided by the own weight of the transport devices, the friction surface can be provided on one of their elements on which pressure rollers or pressure wheels act from above, which are rotatably seated in a stationary manner above the friction wheels.

In accordance with a preferred embodiment of the invention, the transport devices have running rails extending in the direction of movement, which cooperate in the stations with the stationary and rotatably seated guide elements, and they have clamps, known per se, with two movable clamping jaws, the orientation of which permits a straight guidance, parallel to the vertical plane containing the transport cable, of the transport axis of the transport devices in the coupling area, i.e. during the coupling and uncoupling procedure.

The friction surface of each transport device is preferably disposed in a downwardly open U-shaped running rail, the legs of the running rail cooperating with the guide flanks provided on the friction wheels.

In accordance with a preferred embodiment the traveling surface defined by the friction wheels is located, at least at the transfer, lower than the running surface of the transfer rail and furthermore the transport cable is located above this traveling surface at the time of coupling or uncoupling. This allows the disposition of the friction surface or running rail of each transport device below the clamp and that of the transport rollers above it. For this reason the traveling gear can be made very compactly, thus saving weight. Considerable simplification results in the stations, too, with the use of this arrangement, because the suspension of the transfer rail need not extend underneath the path of the clamp.

The invention will be described in detail below in the form of an exemplary embodiment by means of the drawing.

DETAILED DESCRIPTION OF THE PREFERRED EMBODIMENT

Figure 1:
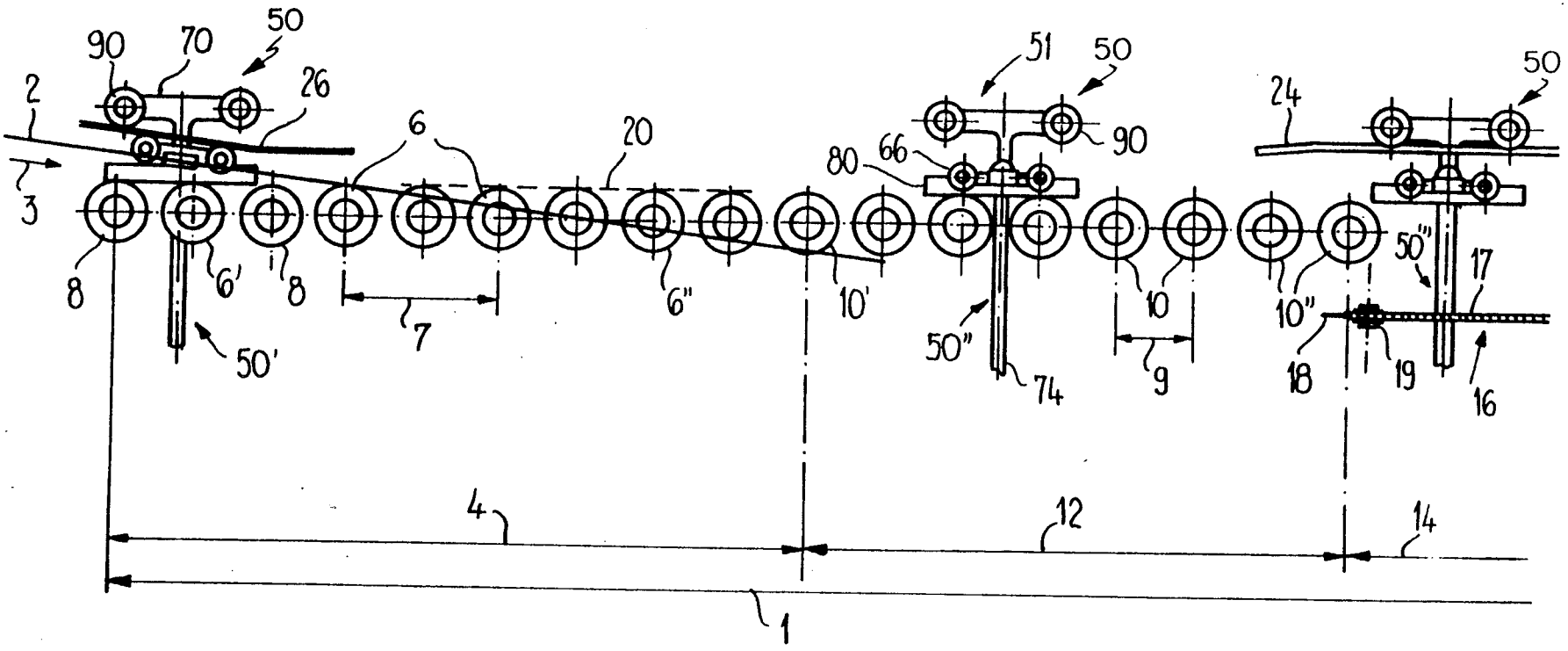
FIG. 1 is a vertical section schematic view of a portion of the transfer segment in a station of an overhead cableway in the form of a chair lift.

The transport cable entering the station has been schematically indicated by 2 in FIG. 1. A travel segment in the form of a deceleration segment 4 is associated with the entering cable 2 in the incoming direction indicated by the arrow 3 and is a portion of the revolving segment 1, which continues as far as the place where the cable leaves the station. The deceleration segment 4 has a set of alternately disposed wheels 6 and 8 of identical diameter, which are fixed in place and rotatable. Another set of wheels 10, also arranged in this manner, is located in a travel segment in the form of an unloading segment 12, which follows the deceleration segment 4 in the incoming direction. The wheels 6 as well as the wheels 10 are driven wheels, the diameter of the latter being the same as that of the wheels 6, 8.

All friction wheels 10 provided in the unloading segment are driven at the same rpm, which is less than the revolving speed of the transport cable 2 and has a set ratio in respect to it. On the other hand, the friction wheels 6 are driven in the incoming direction 3 at rpm which decrease by equal rpm steps. The circumferential speed of the friction wheel 6' corresponds to the revolving speed of the transport cable 2, while the friction wheel 6" has a circumferential speed which is higher by an rpm step than that of the first friction wheel 10'.

With the exception of the interposition of support wheels 8, the arrangement of the friction wheels 6 and 10 corresponds to known deceleration segments or unloading segments. The support wheels 8, the function of which will be discussed below, are seated so that they are free-wheeling. Because of the interposition of support wheels 8, the distance between the axles of adjacent friction wheels 6 is a little more than twice as large as the distance 9 between the axles of adjacent friction wheels 10.

In a manner also known a further travel segment, in this case in the form of a transfer curve 14, follows the unloading segment 12. A chain 17 of a chain conveyor, generally designated by 16, extends along the transfer curve 14. The chain 17, provided with pushers 18, encircles chain wheels, one of which is indicated at 19.

Figure 3:
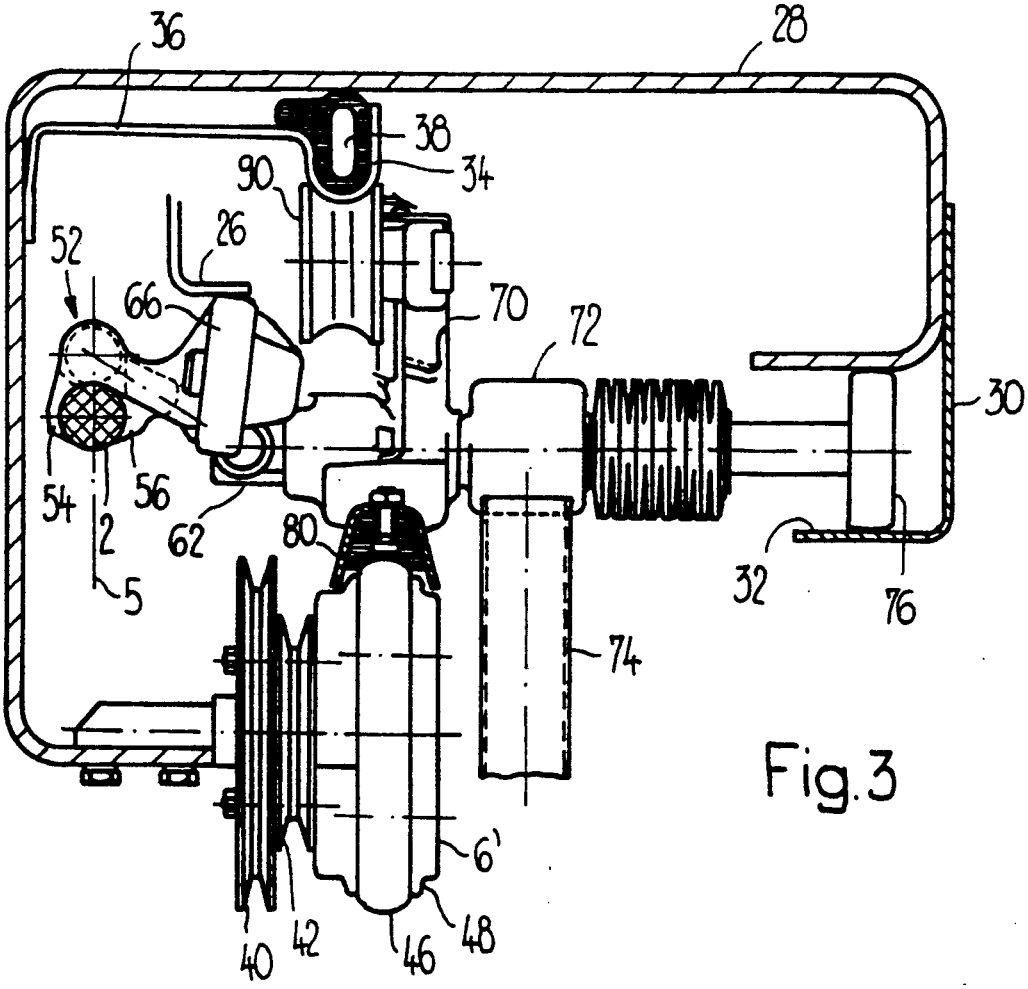
FIG. 3 is a vertical section of the traveling gear in accordance with FIG. 2.

As clearly shown in FIG. 1, a horizontally extending transfer rail 24 located in the transfer curve 14 ends above the two last frictions wheels 10" of the unloading segment 12. Accordingly, no rail used as traveling surface and performing support functions is provided in the area of the segments 4 and 12. Instead, in these segments 4 and 12 the wheels themselves form the traveling surface, indicated by the dashed line 20, replacing such a rail. A known uncoupling rail 26 starts in the area above the first wheels 6, 8 of the deceleration segment 4. Parts of the station buildings, such as are provided in the segment 4 and in the transfer curve 14, are shown in vertical section and partially in plan view in FIGS. 3 and 4. FIG. 3 shows that the wheels 6, 8 and 10 are fastened to a support section 28, on which the uncoupling rail 26 and an angled segment, indicated by 30, are also fastened. The support section 28 and the angled section, which together extend over the length of the segments 4 and 12, together form a U-shaped stabilizing rail 32. Finally, a hold-down rail 34, which may extend in the segment 4 and, if required, also in the segment 12, is resiliently fastened by means of a spring leg 36 on the support section 28 and is braced against the support section 28 in the direction of the spring deflection by a pipe section 38 of flexible rubber. In a known manner the friction wheels 6 are connected with two pulleys 40 and 42 of different diameter, where this connection may have limited free-wheeling, not shown, known per se. Reference is made to Swiss Letters Patent CH-PS 671552, in which such free-wheeling as well as the driving connection between adjacent friction wheels 6 by means of V-belts, not shown here, is described. The friction wheels 10 are connected in a torsion-proof manner with pulleys, all of which have identical diameters, and are interconnected and connected with the drive also by means of V-belts. The transfer rail 24, formed by a round rod, is fastened on a C-section 44 (FIG. 4) which, like the support section 28, can be suspended directly from the roof structure of the station.

Figure 4:
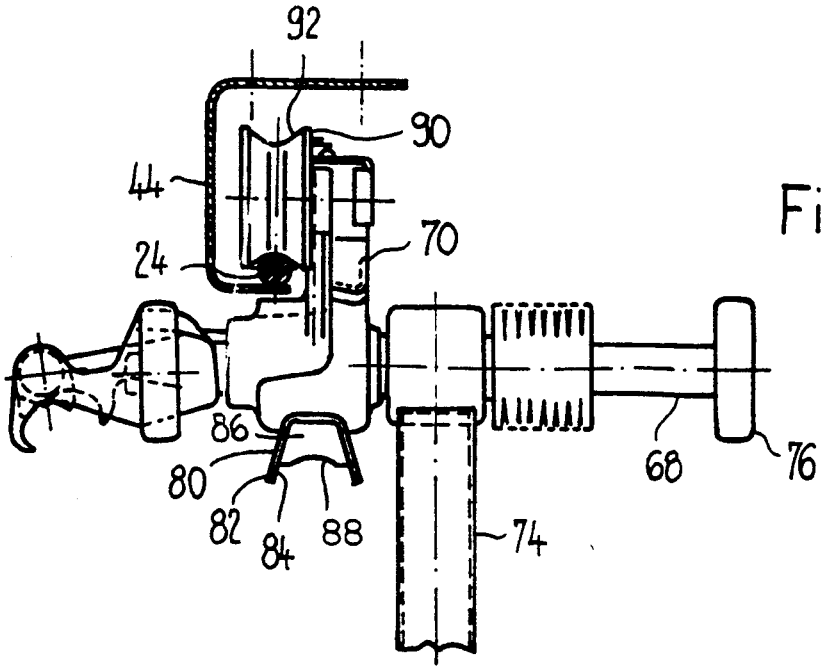
FIG. 4 is a view in accordance with FIG. 3, showing a different disposition of the parts.

Chairs, which are located below the transfer segment 1, are indicated by 50 in FIG. 1 and their design will be described below, making reference to FIGS. 2, 3 and 4.

Figure 2:
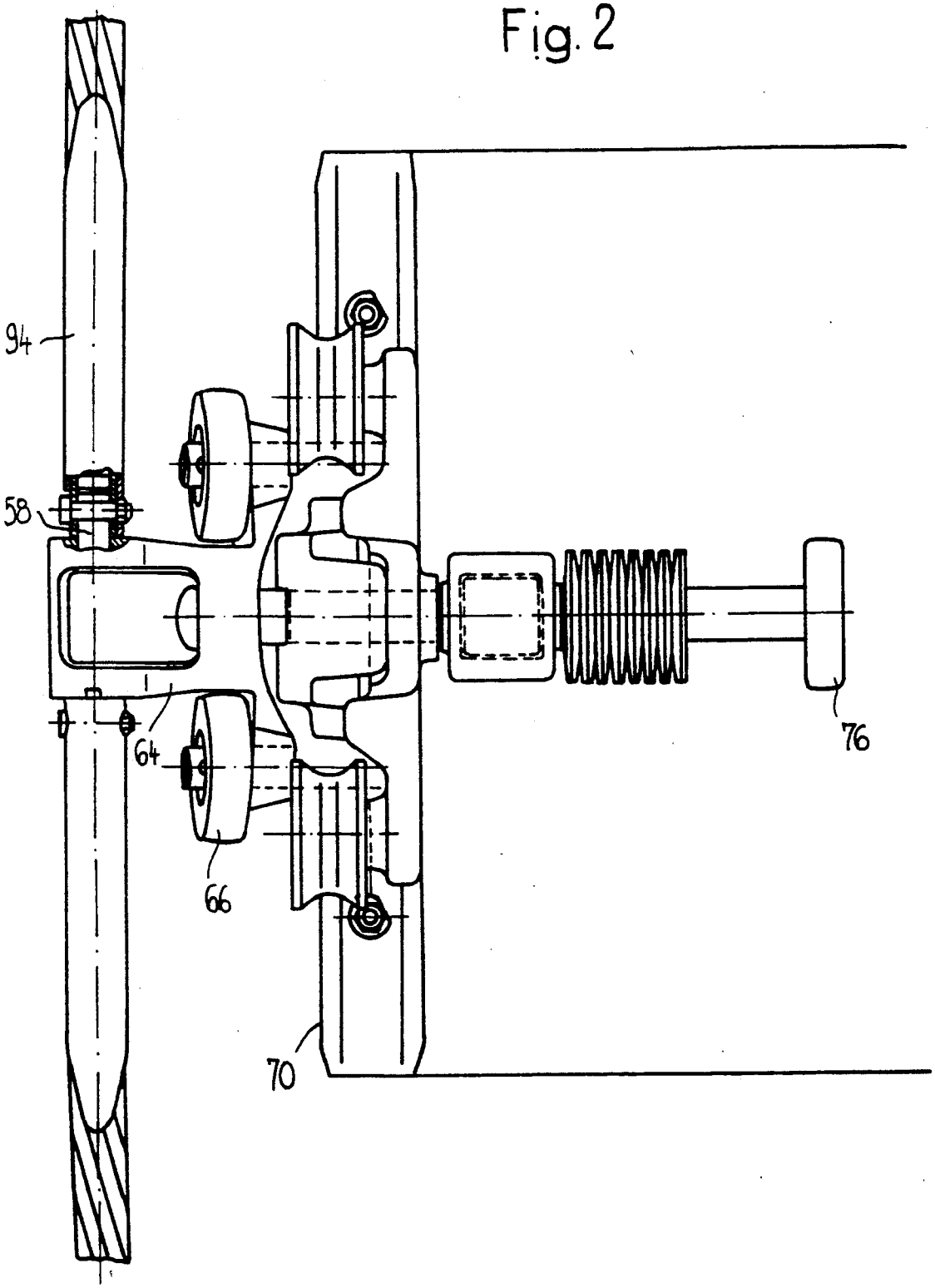
FIG. 2 is a plan view of the traveling gear of a chair coupled to the transport cable.

FIGS. 2 and 3 illustrate an individual chair 50 in the state where it is connected with the transport cable 2 by means of a clamp 52. In respect to its mechanism the clamp may correspond to the one known from Swiss Letters Patent CH-PS 661013. In any event, it is important for the present exemplary embodiment that the clamp 52 has two movable jaws 54 and 56. Thus, when the clamp 52 opens, both jaws 54, 56 can move away from the transport cable 2 by means of the opening movement itself. This means that for the separation of cable and clamp during uncoupling or for their connection during coupling the chair 50 can be maintained on a course extending parallel to a vertical plane 5 (FIG. 3) which contains the transport cable 2.

The clamping jaws 54, 56 are flexibly connected with each other by a bolt 58 and furthermore with a support shaft 62 in a manner not shown in detail. The clamping jaw 54 has an activation arm 64 rigidly connected with it, on which two activation rollers 66 are rotatably seated at a distance from each other, which are intended to cooperate with the rigidly fixed uncoupling rail 26. The support shaft 62 rotatably extends through a traveling gear body 70 as well as a self-aligning bearing 72 of a chair suspension tackle 74. The end 68 of the support shaft 62 facing away from the clamp 52 supports a rotatable guide roller 76, which cooperates with the stabilizing rail 32 to prevent lateral swinging of the chair.

A straight running rail 80 is rigidly fastened on the traveling gear body 70 below the support shaft 62, extending crosswise to it and thus parallel to the vertical plane 3 containing the transport cable 2. The U-shaped running rail 80, open at the bottom, has legs 82, on the insides of which guide surfaces 84 have been formed, and contains a profiled body 86 which is fixedly, but exchangeably connected with it, and on which a downwardly oriented friction surface 88, concave in cross section, is provided. The profiled body 86 preferably is manufactured by molding from an abrasion-resistant material, such as Polyamide 6, which has a high friction coefficient even when wet. To permit exchange after wear, the profiled body 86 might also be fixedly connected as one piece with the running rail 80 and could be replaced together with it.

As clearly shown in FIG. 3, the running rail 80 cooperates by means of its concave friction surface 88 with one of the friction wheels 6 or 10, which are equipped with a correspondingly profiled convex tire 46, the same as the wheels 8. On either side of the tire 46 the wheels 6, 8 and 10 have guide flanks 48, over which the legs 82 of the running rail 80 extend, so that the guide surfaces 84 cooperate with the guide flanks 48. The length of the running rail 80 and of the surfaces 84 and 88 is a little greater than the distance 7 between the axles or twice the distance 9 between the axles, so that it always cooperates with two wheels 6, 8 or 10 in the segments 4 and 12. Accordingly, the chair 50 is not only supported stable in the direction of movement on the wheels, but its straight movement is achieved by lateral guidance.

The traveling gear body 70 has, above the main shaft 62, two rollers 90, spaced apart in the direction of movement, which are rotatably seated and have a concave profile 92. As shown in FIG. 4, the transfer rail 24 engages the profile 92 of the rollers 90 and guides the chairs 50 on the transfer curve 14 when they are moved forward by the chain conveyor 16.

It should be added in regard to the illustration in FIG. 2 that known leading tabs 94 are flexibly fastened on the bolt 58 on both sides of the clamp 52, which are supported on the transport cable 2 and allow the passage of the clamp underneath the hold-down elements of the segment with only little jerking. The operation of the chair lift will be briefly described below. A chair 50' is shown in the deceleration segment 4, a previously arrived chair 50'' in the unloading segment 12 and, finally, a chair 50''' which has reached the transfer curve 14. As will be described in more detail, although the chair 50' is coupled with the transport cable 2, it has already reached the traveling surface 20 and, in accordance with the invention, is supported by the wheels 6 and 8. The chair 50 41, also moving on the traveling surface 20, is supported exclusively by the wheels 10. The chair 50''', however, is located on the transfer rail 24, which supports and guides it in the conventional manner. When a chair 50 enters the station in the course of the revolution of the transport cable 2 in the direction of the arrow 3, it touches with its running rail 80 the wheels 8 and 6', which form the start of the traveling surface 20. In the course of this the guide roller 76 has also entered the stabilizing rail 32, by means of which the lateral position of the chair 50 is determined. At approximately the same time the rollers 90 come into engagement with the hold-down rail 34, by means of which the lengthwise swinging of the traveling gear body 70 and thus a corresponding lifting of the running rail 80 from the wheels 6, 8 is prevented. The activating rollers 66 of the clamp 52 now reach the active area of the uncoupling rail 26 which, during continued movement of the chair in the direction of entering 3, causes the opening of the clamp 52 by means of a movement of the clamping jaws 54, 56 crosswise to the transport cable 2. As the transport cable 2 becomes ineffective, the wheels 6 and 8 take over the support of the chair 50' as well as its guidance in the deceleration segment 4 by means of their already described cooperation with the running rail 80. Under the weight of the chair 50', frictional contact is made between the friction surface 88 and the individual friction wheels 6, so that in accordance with the decreasing circumferential speed of the successive friction wheels 6 it is slowed down step by step from the speed of revolution of the transport cable 2 to the transport speed in the unloading segment 12. It is moved in the direction of the transfer curve 14 at this transport speed, which corresponds to the circumferential speed of the friction wheels 10 which drivingly act on the chair 50'' via the friction surface 88, so that the passengers can leave. Now guidance of the chair is provided by the friction wheels 10 and the guide flanks 48 provided on them. The chair 50''' is taken over in a known manner on the transfer rail 24 by the chain conveyor 16 and moved on. It is shown in FIG. 4 that in its open state the clamp 52 yields downwardly, so that engagement of the C-section supporting the transfer rail 24 under the rollers 90 becomes possible. At the end of the transfer curve 14, not shown, the chain conveyor 16 transfers the chair 50''' to the friction wheels of a loading segment, also not shown, which corresponds to the unloading segment 12. The subsequent acceleration segment, not shown, corresponds in its design to the deceleration segment, and at its delivery end the clamp 52, urged by a coupling rail, again couples the chair to the transport cable 2.

The disposition of the rollers above the support axle and thus also above the clamp makes it possible to support the transfer rail 24 by means of a suitable section directly or at least with little effort, because a suspension which would enclose the clamp is not necessary.

It is to be understood that the revolving segment 1 could also be replaced by a pass-through segment of an overhead cableway with a plurality of sections.

Although the invention has been described above in connection with a chair lift, it can also be employed in other transport arrangements having transport devices which can be uncoupled from the cable, in particular in continuous cableways with cars. In this connection, employment is also possible with overhead cableways where the transport device is connected with the revolving cable(s) by more than one clamp or where one or several support cables are used in addition to a pulling cable.

What is claimed is:

1. An overhead cableway, with a cable revolving between stations and with transport devices having a traveling gear and being connected with the cable via removable clamps, with travel segments at every station comprising driven friction wheels, which act on the transport devices via friction surfaces provided on their traveling gear, and forming at least one deceleration and one acceleration section each, and with guide elements associated with the travel segments, which cooperate with the traveling gear, characterized in that the friction wheels define traveling surfaces and the transport devices are supported by their downwardly oriented friction surfaces directly on the friction wheels, and in that the guide elements are seated rotatably and fixed in place.

2. An overhead cableway in accordance with claim 1, with a transfer rail provided in each station, with which rollers provided on the traveling gear of the transport devices cooperate, characterized in that the transfer rails only extend between travel segments having friction wheels.

3. An overhead cableway in accordance with claim 1 or 2, characterized in that the traveling gear of each transport device is equipped with a straight running rail extending in the direction of movement and having the friction surface as well as guide surfaces.

4. An overhead cableway in accordance with claim 3, characterized in that on the traveling gear body of each transport device, a U-shaped running rail, open towards the bottom and having guide surfaces on its legs, is fastened, which defines the friction surface, and in that the guide elements, which are fixed in place, are formed by guide flanks of the friction wheels, with which they engage the running rail.

5. An overhead cableway in accordance with claim 3, characterized in that the length of the running rail is greater than double the distance between the axles of two friction wheels having the same diameter.

6. An overhead cableway in accordance with claim 3, characterized in that the traveling surface of each traveling segment is supplemented by a support wheel disposed between two adjacent friction wheels and that the length of the running rail is greater than the distance between the axles of two adjacent friction wheels.

7. An overhead cableway in accordance with claim 1, characterized in that a resiliently fastened hold-down rail extends along the travel segments equipped with friction wheels above the traveling surface formed by them, which cooperates with the rollers of the traveling gear.

8. An overhead cableway in accordance with claim 2, characterized in that the rollers are connected above and the friction surface below the clamp of the transport devices with the traveling gear of the latter.

9. An overhead cableway in accordance with claim 4, characterized in that the traveling surface of each traveling segment is supplemented by a support wheel disposed between two adjacent friction wheels and that the length of the running rail is greater than the distance between the axles of two adjacent friction wheels.

10. An overhead cableway in accordance with claim 4, characterized in that the length of the running rail is greater than double the distance between the axles of two friction wheels having the same diameter.

* * * * *